US009278422B2

(12) United States Patent
Barron

(10) Patent No.: US 9,278,422 B2
(45) Date of Patent: Mar. 8, 2016

(54) SYSTEM FOR DRESSING A CENTRIFUGAL CLUTCH

(71) Applicant: The Hilliard Corporation, Elmira, NY (US)

(72) Inventor: Brenton H. Barron, Corning, NY (US)

(73) Assignee: The Hilliard Corporation, Elmira, NY (US)

( * ) Notice: Subject to any disclaimer, the term of this patent is extended or adjusted under 35 U.S.C. 154(b) by 0 days.

(21) Appl. No.: 14/175,435

(22) Filed: Feb. 7, 2014

(65) Prior Publication Data

US 2014/0220868 A1 Aug. 7, 2014

Related U.S. Application Data

(60) Provisional application No. 61/762,002, filed on Feb. 7, 2013.

(51) Int. Cl.

| | |
|---|---|
| ***B24B 5/00*** | (2006.01) |
| ***B24B 19/28*** | (2006.01) |
| ***B24D 9/00*** | (2006.01) |

(52) U.S. Cl.

CPC ..... *B24B 19/28* (2013.01); *B24D 9/003* (2013.01)

(58) Field of Classification Search

CPC ..... B24B 9/00; B24B 9/003; B24B 9/04; B24B 5/00; B24B 19/28

USPC ..... 451/51, 490, 541, 28, 434, 469, 466, 451/465, 180, 61, 440, 902, 319, 317

See application file for complete search history.

(56) References Cited

U.S. PATENT DOCUMENTS

| | | | | |
|---|---|---|---|---|
| 2,549,043 | A * | 4/1951 | Arthur | 451/466 |
| 3,653,856 | A * | 4/1972 | Field | 451/469 |
| 4,563,839 | A * | 1/1986 | Huppert | 451/466 |
| 6,220,949 | B1 * | 4/2001 | Hayashi et al. | 451/548 |

* cited by examiner

*Primary Examiner* — Robert Rose

(74) *Attorney, Agent, or Firm* — Drinker Biddle & Reath LLP

(57) ABSTRACT

A system for dressing centrifugal clutches has a drum tool with an internal abrasive surface, and a flap tool with abrasive flaps. The drum tool can replace the clutch drum on the clutch driven shaft to dress the clutch shoes, or the flap tool can replace the clutch shoes and mechanism on the clutch drive shaft, which may be the engine crankshaft, to dress the clutch drum. In either case, the tool being used and the component being dressed can accurately simulate the engagement of the clutch shoes and clutch drum in operation, so that the clutch drum and shoes can be accurately dressed to the correct shape, matching each other, for use.

6 Claims, 3 Drawing Sheets

SYSTEM FOR DRESSING A CENTRIFUGAL CLUTCH

RELATED APPLICATION

This application is related to and claims priority from U.S. Provisional Application No. 61/762,002, filed Feb. 7, 2013, the disclosure of which is incorporated herein by reference in its entirety.

FIELD OF THE INVENTION

The invention relates to centrifugal clutches and, more particularly, to apparatus and methods for dressing a clutch drum and clutch shoes.

BACKGROUND

The present invention relates to a system for dressing or blueprinting a centrifugal clutch to match the drum and shoes for better performance.

A typical centrifugal clutch has a drive shaft, rotatable by a power source, on which clutch shoes are mounted, and a driven shaft on which a hollow drum is mounted. The drive shaft of the clutch may be the crankshaft of a motor. The clutch shoes are mounted so that they rotate with the drive shaft, but can move outwards into frictional engagement with the inside of the drum when the drive shaft rotates. The frictional engagement transmits rotational motion and torque from the drive shaft to the driven shaft.

In order to provide the best consistent performance (such as torque transfer) for a centrifugal clutch, it is important to match the shoes to the drum. In one current method, a machinist mounts the clutch (without the drum) in a lathe with the shoes spaced out to the engaged position. The lathe is turned on at a slow speed so that the outside of the shoes can be machined to a desired diameter. The drawback with this method is that, since the drum is not in place the clutch has to be rotated at a slow rate so that the shoes do not fly oil the clutch. This, of course, means a slow dressing process. Also, since the shoes are not under load, they do not rotate to the same position that they normally would be in if they were subjected to a torque load. Some clutches are designed such that the shoes rotate several degrees when under load.

Another method to dress the shoes is to leave the shoes on the hub and hold a piece of emery paper to the outside of the shoe and sand the shoes. This method also has drawbacks since there is no way to make sure the shoes are sanded to the correct radius that is needed to match to the drum. Also, it is not possible to replicate the offset that occurs during loading.

In order to dress a drum and remove high spots, one current method is for the person servicing the drum to hold sandpaper in their hand and sand the inside radius. The obvious problem is that there is no way to make sure that the material is removed in a consistent manner. Another method is to use a drill and a small abrasive sanding roll. The roll is pressed against the drum as the person servicing the drum works their way around the inside of the drum. This produces inconsistent results since variations in the pressure and speed as the person sands results in the removal of different amounts of material.

A need, therefore, exists for improved products and methods for dressing the drum and shoes in a centrifugal clutch.

SUMMARY OF THE INVENTION

Aspects of the present invention are directed to methods and tools that are used to dress a drum and shoes in a centrifugal clutch. The tool for dressing the shoes and the tool for dressing the drum can be made, sold, and used as parts of a kit or separately.

One embodiment provides a tool for dressing shoes of a centrifugal clutch, comprising a hollow drum having a generally cylindrical drum portion open at one end, and having a portion for receiving a shaft at an other end opposite said one end and an abrasive lining on an inside surface of the drum portion.

The abrasive lining may be removably and replaceably mounted on said inside surface of said drum portion. Alternatively, the abrasive lining may be a permanent coating.

The shoe dressing tool may be suitably dimensioned to replace a drum of a centrifugal clutch of a kart.

Another embodiment provides a tool for dressing a drum of a centrifugal clutch, comprising a hub configured to be mounted on a drive shaft, at least one bracket extending radially from the hub, and at least one strip of flexible material with an abrasive surface attached to and extending radially from the at least one bracket.

The flexible material is removably and replaceably mounted on the at least one bracket.

The drum dressing tool may be suitably dimensioned to dress a drum of a centrifugal clutch of a kart.

A further embodiment provides a kit comprising both of the above-described tools, where the two tools are sized to dress the drum and the shoes of the same clutch.

Another embodiment provides a method of dressing shoes of a centrifugal clutch, comprising providing a shoe-dressing tool with a drum having an abrasive internal surface, replacing the drum of the clutch with the shoe-dressing tool, causing a drive shall bearing the shoes to rotate at a speed causing frictional surfaces of the shoes to centrifugally engage and rub over the abrasive surface of the shoe-dressing tool, and maintaining the rotation for a time sufficient to dress the frictional surfaces of the shoes.

The shoe-dressing tool may then be replaced with the original drum of the clutch, to bring the clutch back imp use.

Maintaining the rotation may involve repeatedly accelerating the engine and then allowing it to slow to idle.

A further embodiment provides a method of dressing a drum of a centrifugal clutch, comprising providing a drum-dressing tool with at least one strip of flexible material with an abrasive surface attached to and extending radially from a hub, mounting the drum-dressing tool on a drive shaft of the clutch inside the clutch drum, causing the drive shaft to rotate so that the abrasive surface contacts and rubs on an internal frictional surface of the drum, and maintaining the rotation for a time sufficient to dress the frictional surface of the drum.

The drum-dressing tool may then be replaced with the original shoes and mechanism of the clutch, to bring the clutch back into use.

In another embodiment, both of the above-described methods are carried out one after the other before the clutch is reassembled. However, it is expected that in most uses the shoes will be dressed more frequently than the drum.

It is to be understood that both the foregoing general description and the following detailed description are exemplary and explanatory and are intended to provide further explanation of the invention as claimed.

BRIEF DESCRIPTION OF THE DRAWINGS

The above and other aspects, features, and advantages of the disclosed embodiments may be more apparent from the following more particular description of embodiments thereof, presented in conjunction with the following drawings. In the drawings.

DETAILED DESCRIPTION OF THE DRAWINGS

A better understanding of various features and advantages of the present methods and devices may be obtained by reference to the following detailed description of illustrative embodiments and accompanying drawings. Although these drawings depict embodiments of the contemplated methods and devices, they should not be construed as foreclosing alternative or equivalent embodiments apparent to those of ordinary skill in the subject art.

Figure 1:
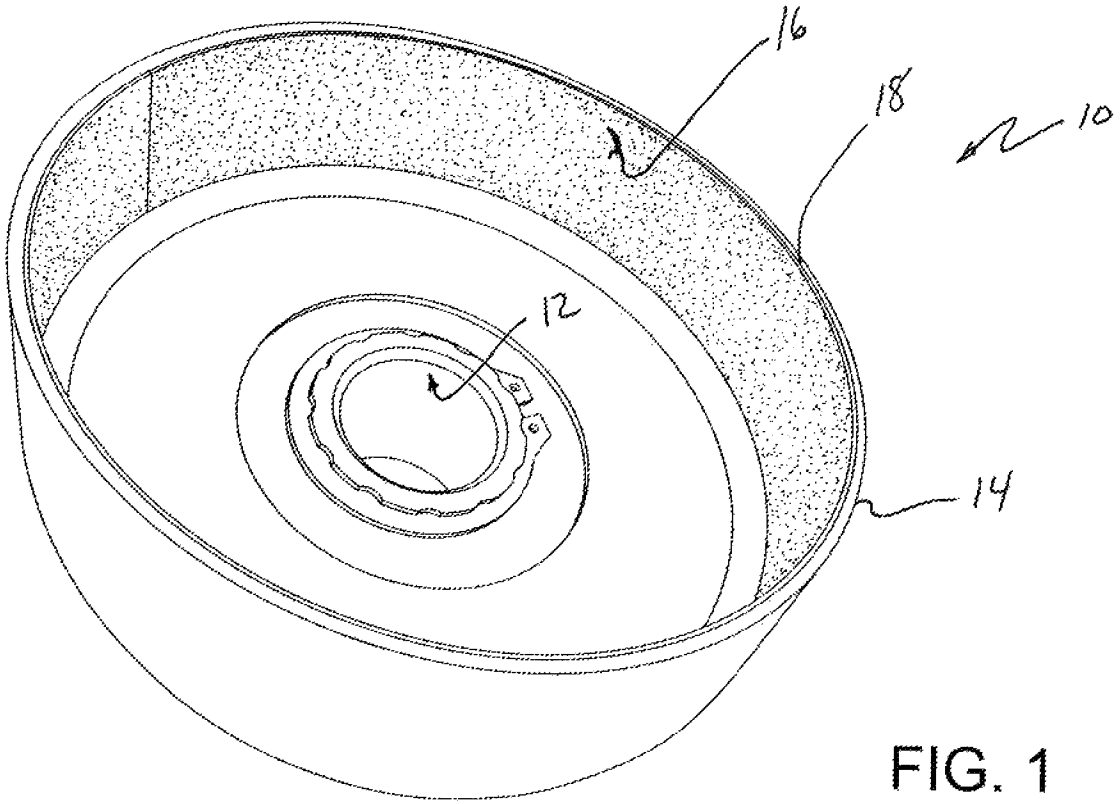
FIG. 1 is a perspective view of an embodiment of an abrasive drum tool for dressing shoes.

Abrasive Drum Tool for Dressing Shoes:

Referring to the accompanying drawings, and initially to FIG. 1, an embodiment of a drum tool indicated generally by the reference numeral 10 is designed so that it can replace the drum of a centrifugal clutch (not shown). The tool 10 has a hub 12 that can be mounted on the output or driven shaft of the clutch, and has a drum portion 14 that then takes up the position of the drum portion of the clutch. The drum portion 14 includes a lining of abrasive material 16 on the radially inside surface 18 of the drum portion. The radially inside surface 18 of the drum portion 14 is machined or formed with an oversized diameter that is larger than the normal drum diameter of the clutch being processed by an amount equal to twice the thickness of the abrasive material 16, such that the inside diameter of the abrasive surface of the tool 10 is the same as the normal inside drum diameter for the clutch being processed.

The abrasive material 16 may be one or more strips of a material with a flexible substrate, such as sandpaper or emery cloth. The abrasive strips are preferably replaceable and may have an adhesive backing to permit them to be attached to the drum. The abrasive material can then be replaced when it wears out. Alternately the surface 18 can be formed with the abrasive material 16 in the form of a lining of an abrasive coating that is strong enough to provide the necessary finishing without deteriorating too quickly. For example, the abrasive material lining may be an electroplated coating of diamond abrasive grit that is applied to the interior surface of the drum. An 80 to 100 grit aluminum oxide has been found satisfactory for the clutches commonly used on karts, but other materials and grit sizes may be used.

In use for dressing the shoes of a centrifugal clutch of a kart, the kart is mounted on lifts or stands. The clutch assembly is removed from the kart. The existing clutch drum is removed from the shoe assembly and the abrasive drum tool 10 is mounted in its place. The mounting of the abrasive drum tool to the shoe assembly in as similar manner as the original clutch drum. The drive chain (which had been removed to remove the original drum) is reinstalled on the clutch mechanism and the entire clutch mechanism with the abrasive drum 10 is mounted on the kart's crankshaft.

The motor on the kart is started and the throttle is depressed to accelerate the motor to a speed at which the clutch shoes engage the inside of the abrasive drum 10 but the clutch does not initially fully engage (allows a slight amount of slip). This allows the clutch shoes to rotate within the abrasive drum tool 10, causing the abrasive surface 16 of the drum portion 14 to wear away the high points on the shoes. This is repeated a few times, and resulting in an accurately trued shoe with a correct curvature to match the shape and size of the drum. One of the significant benefits of this device is that the abrasive drum 10 is used on the clutch while the shoes are under load, thus rotating the shoes and replicating the same position that the shoes would be in during normal acceleration of the kart on the track. As a result, the shoes can be more correctly shaped, with less work, than was previously achievable with conventional devices.

The drum tool 10 can be used to dress a brand new shoe or to resurface a used shoe that has been run a while.

Figure 2:
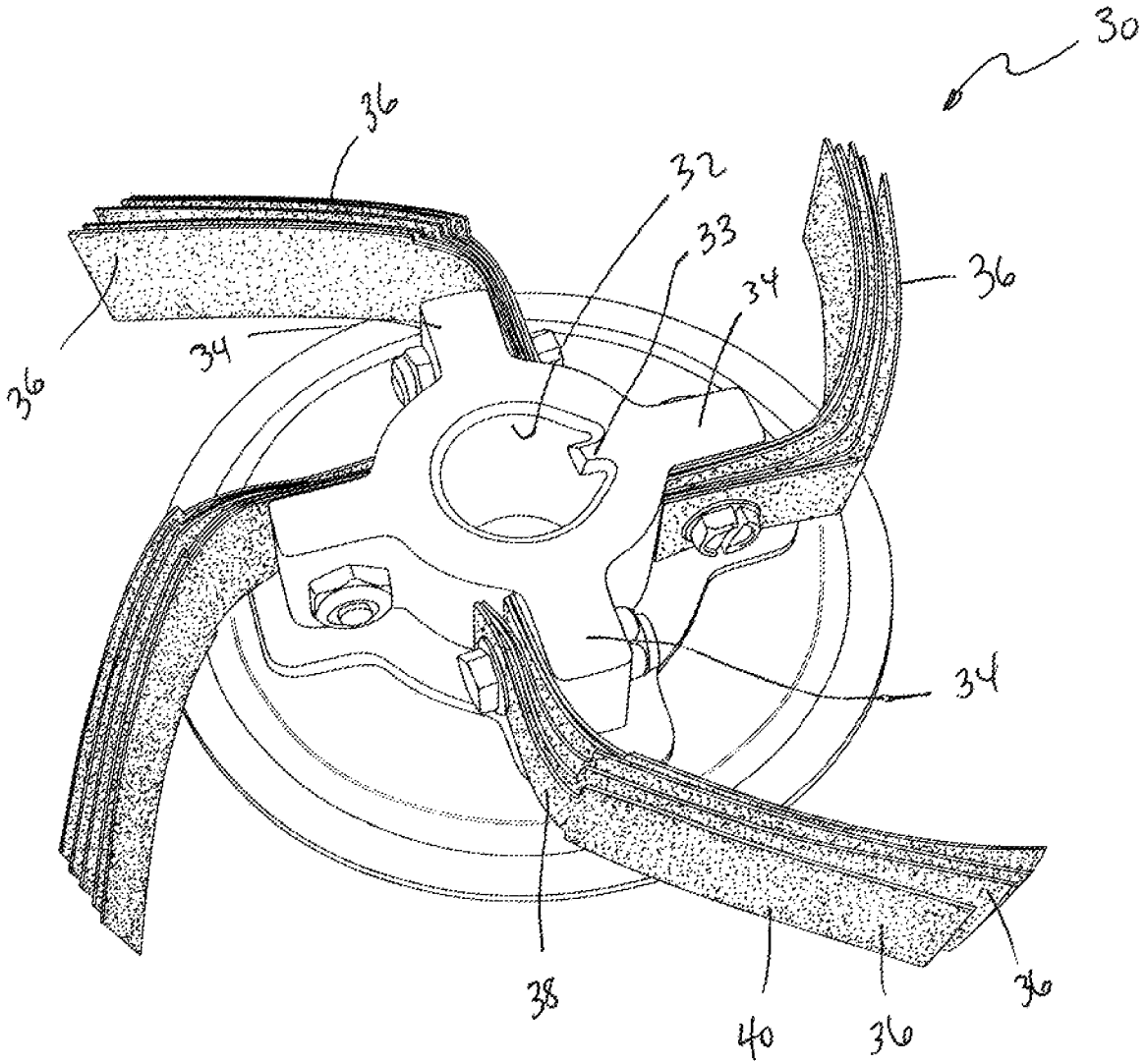
FIG. 2 is a perspective view of an embodiment of a flap-wheel tool for dressing drums.

Flap Wheel Dressing Tool:

Referring now to FIG. 2, an embodiment of a flap wheel dressing tool, indicated by the reference numeral 30, is used for resurfacing the inside of the drum of the centrifugal clutch. The flap-wheel tool 30 includes a center hub 32 designed to engage the crankshaft of the kart's engine. The center hub 32 preferably includes a key 33 or similar mechanism for fixing the hub on the crankshaft. The center hub 32 includes a plurality of radially extending arms 34. In the illustrated embodiment, there are four arms, however there may be fewer or more. The arms are preferably rigid, so as to inhibit significant flexing. Preferably the arms and hub are integral and made from a strong material, such as powered metal.

Figure 3:
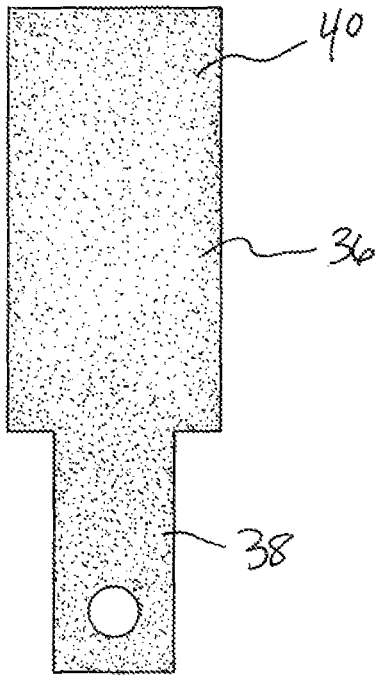
FIG. 3 is a plan view of an abrasive strip of the flap-wheel tool shown in FIG. 2.

Each arm 34 carries at least one, and preferably a plurality of abrasive flaps 36. In one embodiment suitable for the clutch of a kart, the abrasive flaps include a flexible substrate with preferably 80 to 100 grit aluminum oxide coating disposed on it, and the substrate is preferably a J weight backing, which is a lightweight cloth backing. However, other grit sizes, materials, and substrates (backing materials) and weight may be used. Referring also to FIG. 3, in one embodiment the flaps 36 include a 1 inch long by ½ inch wide mounting portion 38 and a 1¾ inch long by ⅞ inch wide flap portion 40. The mounting portions 38 of the flaps 36 are attached to the arms by any suitable mechanism. In one embodiment, the mounting portion of the flap is an extension of the substrate (with or without the abrasive coating.) Of course it should be readily apparent that the mounting portion could be a separate component that permits attachment to the arms. As shown in FIG. 3, a bolt is used which permits the flaps to be replaced when worn.

In use, the clutch mechanism of the kart is removed leaving the existing clutch drum on the kart. The flap wheel dressing tool 30 is attached to the crankshaft of the kart's engine by lining up the integral key 33 on the center hub 32 with a slot or keyway in the crankshaft. The tool 30 is then slid inside the drum. The existing bolt and washer are reinstalled to hold the tool on the shaft. The engine is started and run at idle, e.g., at around 2800 rpm, for about a minute while holding the brake so that the output shaft, with the clutch drum, does not rotate. The engine is then shut off and the flap wheel dressing tool 30 is removed. The flap wheel replicates the same shoe movement as would happen during normal acceleration, and so can match to the drum accurately.

The flap wheel dressing tool 30 provides a convenient mechanism for cleaning and removing galling from the drum, because it uses the engine on the kart to dress the drum and does not need a separate drive system. Also, since the flap wheel dressing tool 30 is mounted to the crankshaft, the abrasive flaps are centered to the drum, there maintaining uniform pressure to remove galling. Because the flap wheel dressing tool is only intended to remove some high spots on the drum, it will likely be used less frequently than the drum tool 10 used for dressing the brake shoes.

The present tools can be made and/or supplied as a kit that includes at least the drum tool 10 and the flap wheel dressing tool 30. The kit may include additional flaps 34 for the flap wheel dressing tool 30 and additional abrasive strips 16 for the drum tool 10. Alternatively, either the drum tool 10 or the flap wheel tool 30 may be supplied separately, either with or without additional abrasive strips 16 or flaps 34.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The invention is therefore not limited by the above described embodiments, methods, and examples, but extends to all embodiments and methods within the scope and spirit of the disclosure.

Accordingly, reference should be made to the appended claims, rather than to the foregoing specification, as indicating the scope of the invention.

The invention claimed is:

1. A kit comprising a shoe-dressing tool for dressing shoes of a centrifugal clutch and a drum-dressing tool for dressing a drum of a centrifugal clutch, wherein:

said shoe-dressing tool comprises:

a hollow drum having a generally cylindrical drum portion open at one end, and having a portion for receiving a shaft at an other end opposite said one end; and an abrasive lining on an inside surface of said drum portion;

said drum-dressing tool comprises:

a hub configured to be mounted on a drive shaft;

at least one bracket extending radially from said hub; and at least one strip of flexible material with an abrasive surface attached to and extending radially from said at least one bracket; and said shoe-dressing tool and said drum-dressing tool are so dimensioned that said drum-dressing tool will dress a drum having the same internal diameter as the drum portion of the shoe-dressing tool.

2. A method of dressing shoes of a centrifugal clutch, comprising:

providing a shoe-dressing tool, comprising:

a hollow drum having a generally cylindrical drum portion open at one end, and having a portion for receiving a shaft at an other end opposite said one end; and an abrasive lining on an inside surface of said drum portion;

replacing a drum of said clutch with said shoe-dressing tool;

causing a drive shaft connected to said shoes to rotate at a speed causing external surfaces of said shoes to centrifugally engage and rub over said abrasive surface of said shoe-dressing tool;

maintaining said rotation for a time sufficient to dress said external surfaces of said shoes.

3. The method of claim 2, further comprising replacing said shoe-dressing tool with said drum of said clutch.

4. The method of claim 3, wherein the abrasive internal surface is a lining of removable abrasive material.

5. The method of claim 3, wherein the abrasive internal surface is a lining formed from an abrasive coating electroplated onto an inner surface of the drum.

6. A method of dressing a drum of a centrifugal clutch, comprising:

providing a drum-dressing tool, comprising:

a hub configured to be mounted on a drive shaft;

at least one bracket extending radially from said hub; and at least one strip of flexible material with an abrasive surface attached to and extending radially from said at least one bracket;

mounting said drum-dressing tool on a drive shaft of said clutch inside said drum;

causing said drive shaft to rotate so that said abrasive surface contacts and rubs on an internal frictional surface of said drum; and maintaining said rotation for a time sufficient to dress said frictional surface of said drum.

* * * * *